313-414
9/15/86 OR 4,612,474

United States Patent [19]

Ashizaki et al.

[11] Patent Number: 4,612,474

[45] Date of Patent: Sep. 16, 1986

[54] IN-LINE TYPE ELECTRON GUN

[75] Inventors: Shigeya Ashizaki, Takatsuki; Masao Natsuhara, Otsu; Koichi Sugahara, Sakai; Hideo Muranishi, Osaka, all of Japan

[73] Assignee: Matsushita Electronics Corporation, Osaka, Japan

[21] Appl. No.: 610,981

[22] PCT Filed: Sep. 14, 1983

[86] PCT No.: PCT/JP83/00308

§ 371 Date: May 9, 1984

§ 102(e) Date: May 9, 1984

[87] PCT Pub. No.: WO84/01238

PCT Pub. Date: Mar. 29, 1984

[30] Foreign Application Priority Data

Sep. 16, 1982 [JP] Japan ..... 57-161613

[51] Int. Cl.[4] ..... H01J 29/50

[52] U.S. Cl. ..... 313/414; 313/413

[58] Field of Search ..... 313/412, 413, 414

[56] References Cited

U.S. PATENT DOCUMENTS 4,291,251 9/1981 Bijma et al. ..... 313/413

FOREIGN PATENT DOCUMENTS 5433816 9/1975 Japan .
52-39366 3/1977 Japan .
5630239 8/1979 Japan .

*Primary Examiner*—Davis L. Willis
*Assistant Examiner*—William L. Oen
*Attorney, Agent, or Firm*—Spencer & Frank

[57] ABSTRACT

An in-line electron gun is constructed according to the present invention such that the common center axes (18*b*), (18*c*) of side beam apertures (16*b*), (16*c*) of a control electrode (12) and an accelerating electrode (13) are displaced toward a tube axis (19) from the center axes (21*b*), (21*c*) of the side beam apertures defined in the end surface of the focussing electrode (14) on the side of the accelerating electrode, and the common center axes (24*b*), (24*c*) of the side beam apertures (23*b*), (23*c*) defined in the opposite end surfaces of the focussing electrode (14) and the anode electrode (15) are displaced toward the tube axis (19) from the common center axes (18*b*), (18*c*) of the side beam apertures (16*b*), (16*c*) of the control electrode (12) and the accelerating electrode (13).

8 Claims, 4 Drawing Figures

IN-LINE TYPE ELECTRON GUN

TECHNICAL FIELD

The present invention relates to an in-line electron gun built in a color picture tube.

BACKGROUND ART

Generally, in a color picture tube comprising an in-line type electron gun from which three electron-beams are emitted into a plane, as shown in FIG. 1, a center beam 1*a* and side beams 1*b*, 1*c* pass through main lenses 2*a*, 2*b*, 2*c*, respectively, to be focussed. In order that the side beams 1*b*, 1*c* are converged to a point 3 at the center of the phosphor screen together with the center beam 1*a*, a beam convergence angle $\theta$ is given between each of the side beams 1*b*, 1*c* and the center beam 1*a*. Also, a self-convergence deflection magnetic field is provided so that the convergence of the three beams 1*a*, 1*b*, 1*c* is performed automatically even at deflection to the peripheries of the screen. In the picture tube system thus constructed, the beam convergence angle $\theta$ affects the beam convergence characteristics over the entire phosphor screen.

The beam convergence angle $\theta$ can be given by arranging three electron guns obliquely. But, in that method, the beam convergence angle $\theta$ is liable to be varied by assembly errors that occur when the three independent electron guns are integrated into an assembled gun. Generally, therefore, a unitized electron gun structure in which the relative displacement of the three electron beams is expected to be small is employed as shown in FIG. 2. A unitized electron gun is described in detail in Japanese Patent Publication No. 4905/77 and others. The center axes 6*b*, 6*c* of the side beam apertures 5*b*, 5*c* among the beam apertures 5*a*, 5*b*, 5*c* at the end of a focussing electrode 4 on the side of an anode electrode, and the center axes 9*b*, 9*c* of the side beam apertures 8*b*, 8*c* among the beam apertures 8*a*, 8*b*, 8*c* at the end of the anode electrode 7 on the side of the focussing electrode are displaced or offset to each other to obtain axially asymmetric side main lenses 10*b*, 10*c*, so that the side beams are electrostatically deflected by the beam convergence angle $\theta$.

Incidentally, in this unitized electron gun structure, the beam convergence angle $\theta$ is determined by the relative positions of the side beam apertures 5*b*, 5*c* of the focussing electrode 4 and the side beams apertures 8*b*, 8*c* of the anode electrode 7, and therefore a very severe manufacturing accuracy is required for the electrodes 4 and 7.

SUMMARY OF THE INVENTION

In the in-line type electron gun according to the present invention, the center axis common to the respective side beam apertures of the control electrode and the accelerating electrode is offset toward the tube axis from the center axis of the side beam aperture of the focussing electrode end surface on the side of the accelerating electrode, and at the same time, the center axis common to the respective side beam apertures at the opposite side surfaces of the focussing electrode and the anode electrode is offset toward the tube axis from the center axis common to the respective side beam apertures of the control electrode and the accelerating electrode.

DETAILED DESCRIPTION OF THE PREFERRED EMBODIMENT

Figure 1:
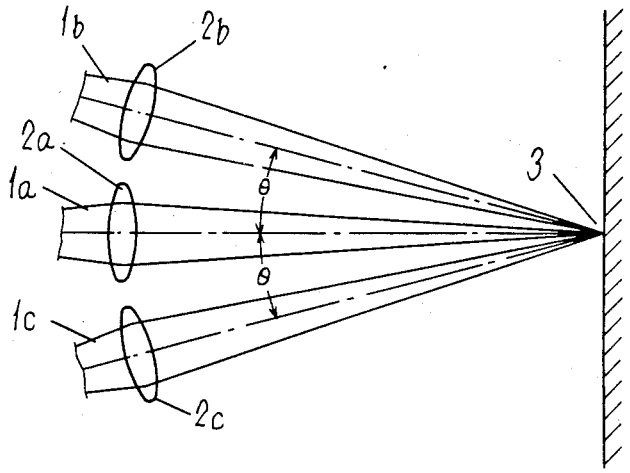
FIG. 1 is a diagram for explaining the convergence of three electron beams by a conventional in-line type electron gun.
Figure 2:
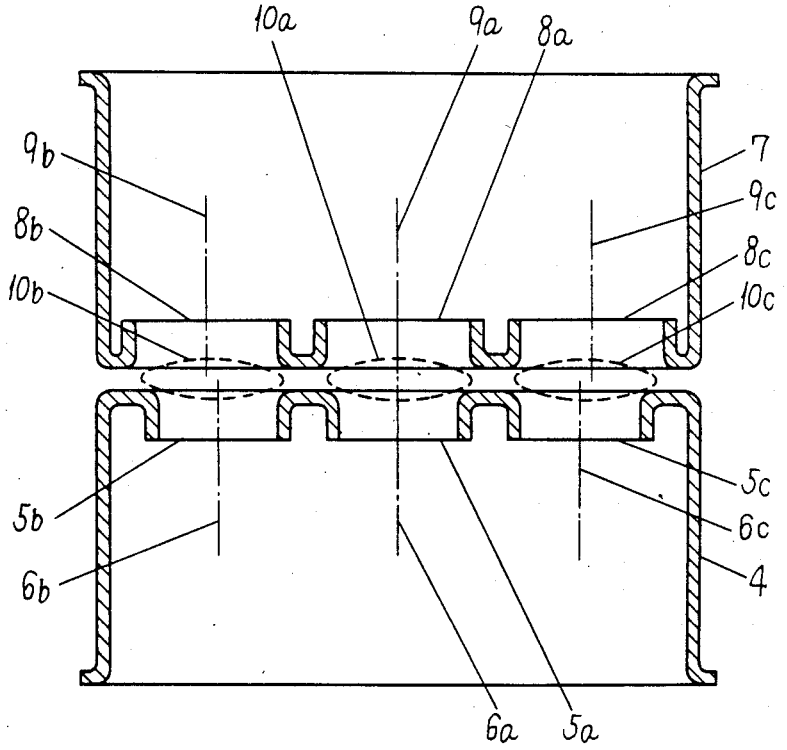
FIG. 2 is a side sectional view showing the electrode configuration of a part of the same electron gun.
Figure 3:
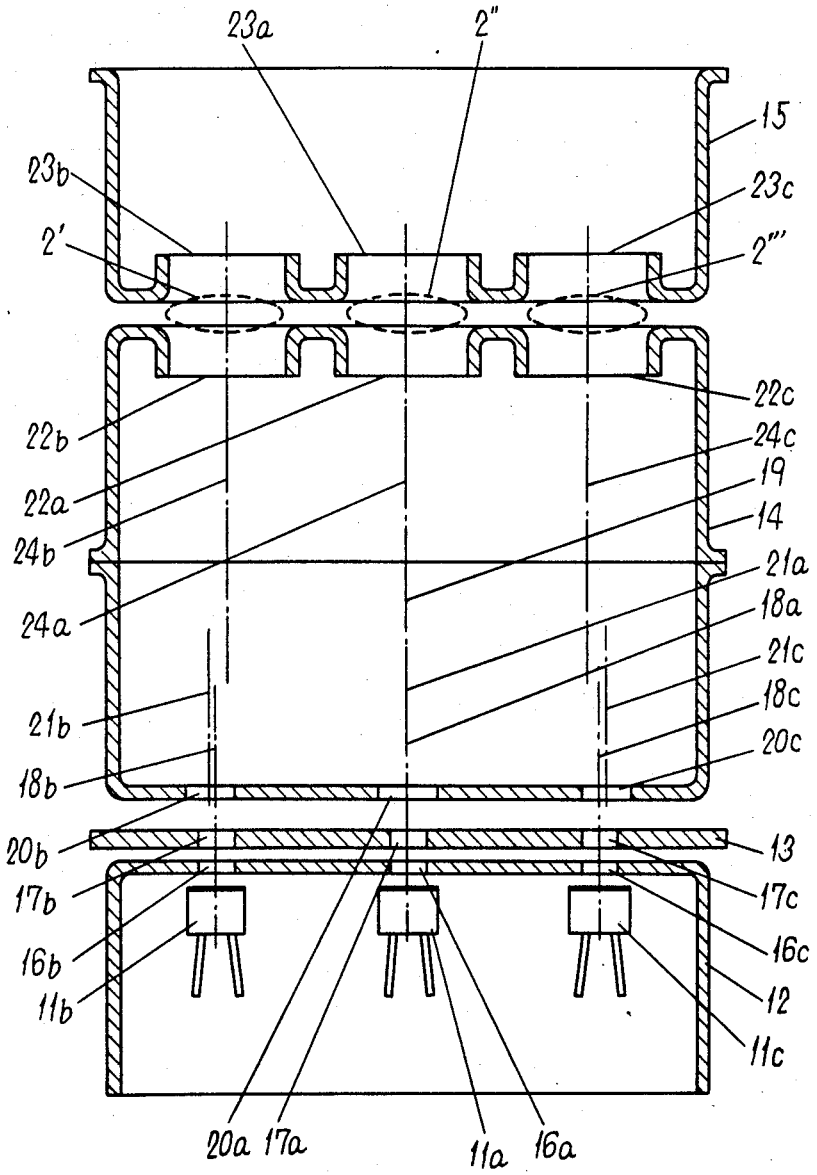
FIG. 3 is a side sectional view of an in-line type electron gun embodying the present invention.

In the preferred embodiment of the invention shown in FIG. 3, three cathode electrodes 11*a*, 11*b*, 11*c*, arranged on a horizontal straight line, a control electrode 12, an accelerating electrode 13, a focussing electrode 14 and an anode electrode 15 make up a unitized in-line electron gun. A center beam aperture 16*a* and side beam apertures 16*b*, 16*c* of the control electrode 12 share common central axes 18*a*, 18*b*, 18*c* respectively with a center beam aperture 17*a* and side beam apertures 17*b*, 17*c* of the accelerating electrode 13. The center axis 18*a* common to the center beam apertures 16*a* and 17*a* is coaxial with the tube axis 19.

As shown in FIG. 3, the anode electrode 15 preferably is a cup shaped member provided in its end surface with a center beam aperture 23*a* and side beam apertures 23*b* and 23*c*, and the focusing electrode 14 preferably is a composite member formed of two axially joined cup-shaped members, each provided in its end surface with respective center and side beam apertures 20*a*, 20*b*, 20*c* (which are disposed opposite the beam apertures 17*a*, 17*b* and 17*c*, respectively, of the accelerating electrode 13) and 22*a*, 22*b*, 22*c* (which are disposed opposite the beam apertures 22*a*, 22*b*, 22*c*, respectively, of the anode electrode 15). As shown, the one of the the cup-shaped members of the focusing electrode 14 whose end surface faces, i.e. is opposite, the end surface of the anode electrode 15 is of the same size and shape as the anode electrode 15.

The center axis 21*a* of the center beam aperture of the focussing electrode 14 on the side of the accelerating electrode 13, is coaxial with the tube axis 19. However, the center axes 21*b*, 21*c* of the side beam apertures 20*b*, 20*c* respectively are displaced from the above-mentioned common center axes 18*b*, 18*c* respectively. In other words, the common center axes 18*b*, 18*c* for the side beam apertures 16*b*, 16*c*, 17*b*, 17*c* of the control electrode 12 and the accelerating electrode 13 respectively are offset toward the tube axis from the center axes 21*b*, 21*c* of the side beam apertures 20*b*, 20*c* of the focussing electrode 14 on the side of the accelerating electrode 13.

Further, the center beam aperture 22*a* and the side beam apertures 22*b*, 22*c* of the focussing electrode 14 on the side of the final accelerating electrode 15 share common center axes 24*a*, 24*b*, 24*c* respectively with the center beam aperture 23*a*, and the side beam apertures 23*b*, 23*c* of the final accelerating electrode 15 on the side of the focussing electrode. The common center axis 24*a* for the center beam apertures 22*a*, 23*a* is coaxial with the tube axis 19, while the common center axes 24*b*, 24*c* for the side beam apertures 22*b*, 22*c*, 23*b*, 23*c* respectively are offset toward the tube axis from the common center axes 18*b*, 18*c* respectively.

In the in-line electron gun constructed in this way, an axially symmetric prefocus lens electric field is formed between the center beam aperture 17*a* of the accelerating electrode 13 and the center beam aperture 20*a* of the focussing electrode 14, while axially-asymmetric prefocus lens electric fields are formed between the side beam apertures 17*b*, 17*c* of the accelerating electrode 13 and the side beam apertures 20*b*, 20*c* of the focussing electrode 14 respectively. As a result, the three electron beams generated from the three cathode electrodes 11*a*, 11*b*, 11*c* and passed through the center beam aperture 16*a* and the side beam apertures 16*b*, 16*c* of the control electrode 12 are pre-focussed by said prefocus lens electric fields. Since the both side prefocus lens electric fields are axially asymmetric, the side beams are deflected slightly toward the tube axis.

Figure 4:
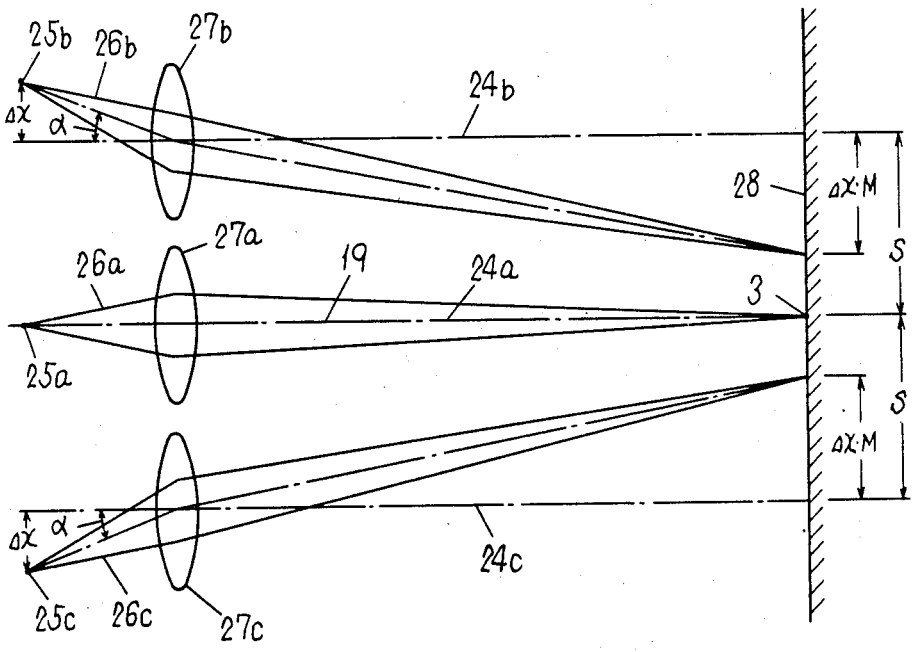
FIG. 4 is a diagram for explaining the convergence of three electron beams from the electron gun shown in FIG. 3.

FIG. 4 shows three prefocus lens sections as equivalent electron sources 25*a*, 25*b*, 25*c*. The equivalent electron sources 25*b*, 25*c* on the both sides are displaced from the above-mentioned common center axes 24*b*, 24*c* respectively by Δx. The center beam 26*a* advances straight along the tube axis 19 and enters the axially-symmetric center main lens 27*a* on the tube axis 19, while the side beams 26*b*, 26*c* advance obliquely at an angle of α and enter the axially-symmetric side main lenses 27*b*, 27*c*.

The center beam 26*a* and the side beams 26*b*, 26*c* are focussed respectively by the main lenses 27*a*, 27*b*, 27*c*, and in the absence of the deflection magnetic field acting thereon, the side beams 26*b*, 26*c* are biased by Δx·M from the center axes 24*b*, 24*c* on the phosphor screen 28. M indicates the lens magnification.

Therefore, when the center displacement Δx is set so that the bias amount (Δx·M) is equal to the distance S between the center axes 24*b*, 24*c* and the tube axis 19 ($\Delta x \cdot M = S$), the center beam 26*a* and the side beams 26*b*, 26*c* can be converged to a point at the center on the phosphor screen 28.

The prefocus lenses on both sides 26*b*, 26*c* are axially asymmetric. If the respective amounts of displacement of the center axes 18*b*, 18*c* from the center axes 21*b*, 21*c* are appropriately set to provide an appropriate inclination angle α, the beam spot (bright spot) on the phosphor screen 28 can be made a true circle. Also, since the center axes of the associated beam apertures 22 and 23 on the respective opposed or facing side ends of the focussing electrode 14 and on the final accelerating electrode 15 are not required to be displaced from each other, the half of the focussing electrode 14 facing the final accelerating electrode or anode 15 can be formed in the same press die used for forming the final accelerating electrode 15. Thus convergence failures caused by variations in the shape of the electrodes 14, 15 can be reduced. Further, even when a satisfactory roundness of the beam apertures cannot be obtained due to the natures inherent to the press die, at least the opposite side ends of the electrodes 14, 15 can be reversely combined in their upper and lower relation, and therefore a superior beam spot shape with a high uniformity of convergence can be obtained.

INDUSTRIAL APPLICABILITY

As explained above, the in-line electron gun according to the present invention facilitates the manufacture, management and assembly of the focussing electrode and final accelerating electrode of comparatively complicated construction, thus producing a superior beam spot shape, that is, a high-resolution characteristic.

We claim:

1. In an in-line electron gun for producing a center beam and side beams which is enclosed in a tube having a main tube axis, with said gun including a plurality of cathodes, and serially arranged control, accelerating, focussing and anode electrodes for said cathodes, and with each said electrode having a center beam aperture, whose respective center axes are all aligned with said tube axis, and having side beam apertures whose respective center axes are all parallel to said tube axis, the improvement wherein for each side beam: the side beam aperture of said control electrode and of said accelerating electrode have a common center axis which is displaced toward the tube axis from the center axis of the side beam aperture defined in the end surface of said focussing electrode on the side of said accelerating electrode; and the associated side beam apertures respectively defined in the opposed end surfaces of said focussing electrode and said anode electrode have the same diameter, and have a common center axis which is displaced toward the tube axis from said common center axis of the side beam apertures of said control electrode and said accelerating electrode.

2. An in-line electron gun enclosed in a tube and comprising: three cathode electrodes arranged in a straight line, a control electrode, an accelerating electrode, a focussing electrode and an anode electrode; each of said control electrode, said accelerating electrode, said focussing electrode and said anode electrode having a center beam aperture and side beam apertures; the common center axis of the respective side beam apertures of said control electrode and said accelerating electrode being displaced toward the tube axis from the center axis of the side beam apertures defined in the end surface of said focussing electrode on the side of said accelerating electrode; and the associated side beam apertures respectively defined in the opposed end surfaces of said focussing electrode and said anode electrode have a common center axis which is displaced toward the tube axis from the common center axis of the respective side beam apertures of said control electrode and said accelerating electrode.

3. An in-line electron gun enclosed in a tube and comprising: three cathode electrodes arranged in a straight line, a control electrode, an accelerating electrode, a focussing electrode and an anode electrode; said focussing electrode including a first cup-shaped member of the same size and shape as said anode electrode and positioned on the side of the same and a second cup-shaped member positioned on the side of said accelerating electrode, the common center axis of each side beam aperture of said control electrode and said accelerating electrode being displaced toward the tube axis from the center axis of a side beam aperture of the second cup-shaped member end surface of said focussing electrode, and the common center axis of the side beam apertures respectively defined in the opposed end-surfaces of said anode electrode and said first cup shaped member being displaced toward the tube axis from the common axis of the respective side beam apertures of said control electrode and said accelerating electrode.

4. An in-line electron gun according to claim 3, characterized in that said first cup-shaped member and said anode electrode are each formed by mold pressing using a common die.

5. An in-line electron gun according to claim 1, wherein a relation $S = \Delta x \cdot M$ holds where Δx designates the distance of displacement between the center axis of a prefocus lens formed by the respective side beam apertures of said control electrode and said accelerating electrode and the common center axis of the respective side beams of said focussing electrode and said anode electrode, S designates the inter-axis distance between the center axis of the center beam and said common center axis of the respective side beams, and M designates the magnification of a main lens formed by said focussing electrode and said anode electrode.

6. An in-line electron gun according to claim 2, wherein a relation $S=\Delta x \cdot M$ holds where $\Delta x$ designates the distance of displacement between the center axis of a prefocus lens formed by the respective side beam apertures of said control electrode and said accelerating electrode and the common center axis of the respective side beams of said focussing electrode and said anode electrode, S designates the inter-axis distance between the center axis of the center beam and said common center axis of the respective side beams, and M designates the magnification of a main lens formed by said focussing electrode and said anode electrode.

7. An in-line electron gun according to claim 3, wherein a relation $S=\Delta x \cdot M$ holds where $\Delta x$ designates the distance of displacement between the center axis of a prefocus lens formed by the respective side beam apertures of said control electrode and said accelerating electrode and the common center axis of the respective side beams of said focussing electrode and said anode electrode, S designates the inter-axis distance between the center axis of the center beam and said common center axis of the respective side beams, and M designates the magnification of a main lens formed by said focussing electrode and said anode electrode.

8. An in-line electron gun according to claim 2 wherein said associated side beam apertures of said focussing electrode and of said anode electrode are of the same diameter.

* * * * *